United States Patent [19]

Levine

[11] 4,205,846

[45] Jun. 3, 1980

[54] TARGET PANEL

[76] Inventor: Alfred B. Levine, Suite 418, Barr Bldg 910-17th St., NW., Washington, D.C. 20006

[21] Appl. No.: 952,992

[22] Filed: Oct. 20, 1978

Related U.S. Application Data

[62] Division of Ser. No. 758,153, Jan. 10, 1977, Pat. No. 4,157,182.

[51] Int. Cl.[2] ..... A63B 9/02; F41J 5/00

[52] U.S. Cl. ..... 273/310; 250/486; 273/DIG. 24

[58] Field of Search ..... 272/101.1, 102 R, 102.1 R, 272/102.1 C, 102.2 R, DIG. 24; 35/25; 250/483, 484, 486–488; 428/917; 252/301.16

[56] References Cited

U.S. PATENT DOCUMENTS

| | | | |
|---|---|---|---|
| 2,236,390 | 3/1941 | Wood et al. | 273/101.1 |
| 2,739,243 | 3/1956 | Sheldon | 250/484 X |
| 2,826,677 | 3/1958 | Jobanek | 273/101.1 X |
| 2,970,239 | 1/1961 | Riggen | 250/487 X |
| 2,975,318 | 3/1961 | Nicoll | 250/484 X |
| 2,976,447 | 3/1961 | McNaney | 250/484 X |
| 3,043,710 | 7/1962 | Patten et al. | 250/487 X |
| 3,240,924 | 3/1966 | Darby | 273/102 R X |
| 3,253,146 | 5/1966 | De Vries | 250/487 |
| 3,590,253 | 6/1971 | Novice | 250/484 X |
| 3,829,684 | 8/1974 | Assouline et al. | 250/484 X |

*Primary Examiner*—Vance Y. Hum

[57] ABSTRACT

A target game or practice device using a movable beam from a light projector (e.g. gun) and a target support that includes an electroluminescent or light emitting layer having a light scintillating material to generate light at the position of impingement of the projector light beam in response to a photoconductive layer at that position being rendered more conductive by the light to apply a power source to the electro-responsive light emitting layer and thereby visually indicate the position in a persisting manner.

3 Claims, 4 Drawing Figures

TARGET PANEL

This application is a division of application Ser. No. 758,153, filed Jan. 10, 1977 now U.S. Pat. No. 4,157,182.

BACKGROUND OF THE INVENTION AND PRIOR ART

The invention relates to light beam target practice devices and games, and more particularly to such devices employing electrical or electrostatic targets for indicating the position or location of the beam striking the target.

In the past light beam responsive targets have generally employed photocell operating devices, either alone or in banks, together with visual or audible indicators to signal "hits" and total the scores of "hits" on the target. For home use as a game or toy, as for use by children, it is often desired to provide a less expensive electrical target that is capable of providing the same or even greater enjoyment to the user but at lower cost than in the past.

For other applications, including military or police training uses, it is often desired to provide a completely "solid state" electrical or electrostatic target. Such a target may be advantageously used for precision target practice, or in games, using a precision light beam producing gun, such as a laser generator.

SUMMARY OF THE INVENTION

According to the present invention, there is provided a light beam target game or practice device employing an improved electrostatic target that may be constructed in "solid state" electronic form without electromechanical components. In one preferred embodiment, the target may include a photoconductive layer for receiving and retaining a static electrostatic charge to removably hold preplaced target objects. Upon the light beam striking a target object, the static charge is dissipated by the photoconductor layer to release the object; allowing it to fall from the target as if struck by a missile.

To enhance the sensitivity of the target to the projected light beam, the target objects or target support may also include a light emissive material within the wavelength sensitivity of the photoconductor. Upon receiving the light beam from the projector, the emissive material fluoresces or scintillates to emit light in a regenerative manner to more efficiently release the target objects from the target. This scintillation also provides a visual indication of the target position struck by the light beam; which indication may be made to persist after the projected light beam is terminated.

In a more elaborate target construction, the target may include a battery or other powering source to provide a dynamic electrostatic field, together with means enabling a continuing visual display of the "hits" and/or "misses" by the projected light beam from the gun.

SUMMARY OF THE DRAWINGS

Referring to FIGS. 1 and 2, there is shown a simplified electrostatic target 10 according to the invention for use in an inexpensive light beam target game for home or like uses. The target 10 is comprised of a suitable support or backing 11 having a discontinuous area photoconductive layer or coating 12 supported on its front surface. The photoconductive layer 12 that is chosen is of a suitable selenium composition, or of other known and available organic or other photoconductive material, that provides a high value of electrical resistance under ordinary ambient lighting conditions for supporting a static electrostatic charge on its surface. When subjected to a higher level of light such as a concentrated light beam 16, however, the layer 12 is selectively rendered more electrically conductive at the descrete positions receiving the light beam to bleed away or dissipate the electrostatic charge at those positions.

Figure 1:
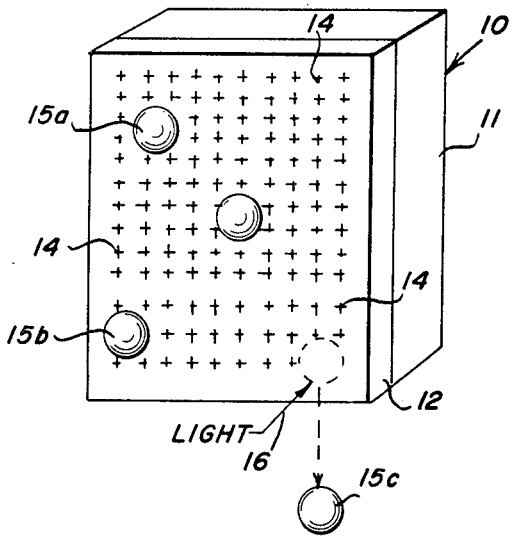
FIG. 1 is a perspective view illustrating an electrostatic target releaseably holding plural preplaced target objects according to the invention.
Figure 2:
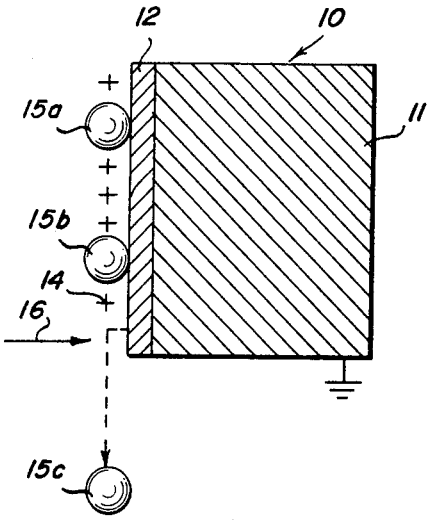
FIG. 2 is a sectional view taken along lines 2—2 of FIG. 1.

Supported on this target by the electrostatically generated holding forces are a plurality of small lightweight nonconductive target objects **15*a*, 15*b*, and 15*c*. These target objects may be preplaced by the user at any desired locations on the charged surface of the target board, layer 12, and are preferably made in the form of small transparent or translucent discs or balls of porous or fibrous plastic material, or of translucent paper, that are capable of being electrostatically attracted to and retained on the charged layer 12** at the positions preplaced by the user.

For use with this electrostatic target 10 is a light beam projecting device, that may be in the form of a conventionally shaped gun or rifle (not shown), such that it may be aimed at the target 10 by the user and "fired" to project a concentrated beam of light 16. Battery operated portable light guns and rifles of this kind are so well known and widely used in other light target games and practice devices that a further description is considered unnecessary. For more precision training uses, however, it will be appreciated that laser beam emitting rifles and guns may preferably be employed, as well as other high intensity lights, such as electronically operated light flashing devices such as are now commonly used for photographic purposes.

In use, the photoconductive target layer 12 is initially provided with a triboelectrostatically charged surface, as indicated at 14, by the user frictionally rubbing its surface with an appropriate cloth or fibrous mass (not shown). The small, lightweight, transparent target objects **15*a*, 15*b*, 15*c*, are then placed at the desired locations on the target 14 and retained thereon by the electrostatic holding forces. After preparing the target for operation, the light gun is aimed at selected target objects and a concentrated light beam is "fired" at the target by the gun. In the event that the light beam 16 strikes the photoconductive target layer 12 at the position occupied by one of the transparent or translucent target objects such as 15*a*; the static charge at that position is dissipated by the photoconductor 12 becoming more electrically conductive at that position to conduct away the charge, whereupon the electrostatic holding force is dissipated or reduced and that target object 15*a* drops away from the target 10** and falls. This falling action simulates the action of the target being struck by a tangible missile, and provides a clearly visible indication of the users accuracy in aiming and firing of the light "gun".

If desired, a variety of differently sized target objects 15 (not shown) may be used, with the smaller target objects bearing a greater number marking thereon than the number on the larger objects. In this manner the user can compile larger point scores by hitting the smaller targets, such as for competitive game play or practice purposes.

To prevent the falling target objects 15 from being attracted to a lower portion of charged surface of the target layer 12 as it falls after being "hit" by a light beam 16 as described above, the target object 15, may be provided with a light emitting or fluorescing coating or layer that scintillates, fluoresces, or otherwise produces light for a persisting time period after it is struck by the projected light beam 16. This provides a regenerative light emission action to further insure that the target object 15 is properly released from the target board 10 and that it continues its fall from the target board. If desired, the use of a suitable scintillating material on the objects 15*a*, may product a brief decaying light burst, simulating a minor explosion as the object 15 is "hit" by the projected light beam 16, thereby enhancing the users enjoyment of the device by more vividly and prominantly displaying the "hits".

Figure 3:
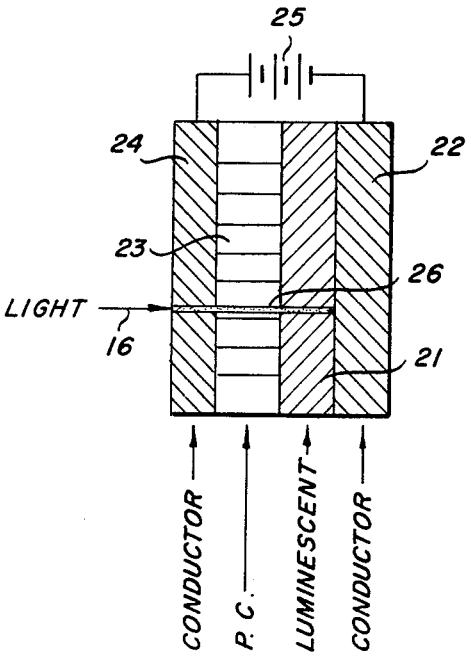
FIG. 3 is a sectional view, similar to FIG. 2, and illustrating a dynamically powered electrostatic target.

In an alternative construction of the electrical target as shown in FIG. 3, the target 20 is so constructed as to visually display the locations of the "hits" by producing persisting spots of light at those positions that are struck by the light beam 16.

In this latter construction of FIG. 3, the target 20 is preferably provided with an electrically conductive backing or support layer 21, followed by a first layer of electroluminescent material 22, a second transparent or translucent photoconductive layer 23, and finally by a layer of transparent conductive material 24. These layers are intimately connected together, in a sandwich construction as shown, and energized by a powering source 25 that is applied across the two outer conductive layers 21 and 24 to provide a transverse electric field passing through the sandwich target.

The photoconductive layer 23 normally provides a high resistive insulation serving as an electrical barrier between the electroluminescent layer 22 and the powering source 25. However when the target 20 is struck by the light beam 16 from the target gun (not shown), the photoconductor becomes less resistive at the position 26 struck by the light beam 16. The voltage from source 25 applied across the electroluminescent layer 22 is thereupon sufficiently increased to bring this layer into fluorescence at that position 26, producing a spot of emitted light at that position. The spot of light at 26, in turn, maintains the photoconductor 23 in a continuing state of low resistance at that position 26, thereby creating a persisting light spot indication of the "hit" position on the target 20 even after the light beam 16 from the gun has been withdrawn. To prevent progressive spreading of this light spot onto adjoining areas of the photoconductor layer 23, the photoconductive layer 23 in FIG. 3 is not formed as a continuous layer over the backing or electroluminescent layer 22, but instead is provided in a discontinuous spatial pattern, such as a mosaic of discontinuous spatial areas over its support surface.

Figure 4:
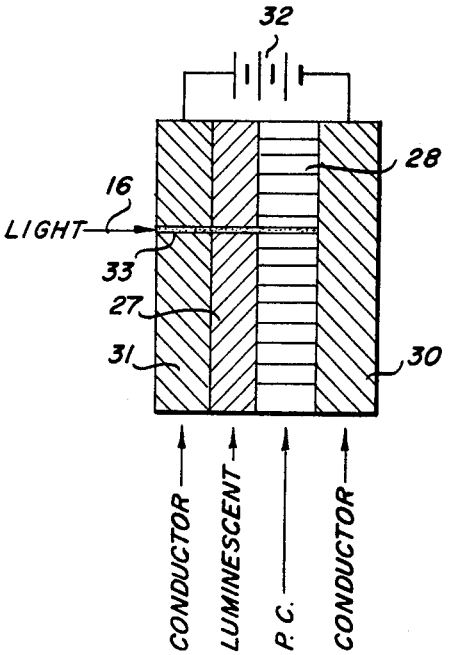
FIG. 4 is a similar sectional view similar to FIG. 3, and illustrating an alternative construction.

In an alternative arrangement of FIG. 4, the electroluminescent layer 27 may be reversed with that of the photoconductor layer 28, and may be made partially or semi-transparent to the light beam 16. Upon light from beam 16 passing through layer 27, the photoconductor 28, is made more conductive at that spot position 29, creating the necessary voltage across layer 27 from the power source 32 to luminesce and be self-perpetuating as a luminous spot, in the same manner as discussed above.

To further enhance the sensitivity of the target of FIG. 4, the electroluminescent layer 27 may be provided with a mixture of, or otherwise be combined with, a scintillation material that responds to the light beam 16 to reradiate light at the received position of spot 33. This reradiated light, in turn, reduces the electrical resistance of photoconductive layer 28 at position 29 to create the electroluminescence in the layer 27, in the manner as discussed above, thereby perpetuating the visible light spot indication of the "hit" position. In this embodiment, therefore, the combination of light scintillation and electroluminescence is employed to provide an amplified response of the target to the light beam 16 from the target gun.

It will be appreciated by those skilled in the art that many changes may be made in the embodiments described without departing from the scope of the invention. For example, in the construction of FIG. 1, the electrostatic charge 14 on the photoconductor surface 12 may alternatively be provided by applying high voltage ionization (e.g. by a corotron), or by other known electrical means instead of triboelectrically, (by friction), as described.

Any number of various known materials and combinations thereof, may be used to provide photoconductive layers, electroluminescent layers, scintillation layers and the like for practising this invention. The degree of sophistication of the target involved will, of course, depend upon the cost of the device and other conditions, such as the degree of safety required where the target is to be used as a toy by children.

To more desirably simulate the operation of a conventional projectile firing gun and target, the projected light beam 16 may be emitted in bursts or pulses when the trigger of the gun (not shown) is actuated. For example, the gun may employ a high intensity photographic type light flash emitter tube whose electronic firing circuit is activated to "fire" the tube each time the trigger operated switch is actuated. When employing a target having a light sensitive scintillation layer in combination with such a light pulsing gun, each of the "hits" on the target is visually displayed by a persisting spot of light that appears at each of the "hit" positions and remains long after the light pulse from the gun has expired. Where the target is also visually printed or marked with concentric bulls-eye circles that are numbered, the user can easily total his score by adding the number in the regions containing the light spots.

Many different combinations or variations of the above described features may also be employed in providing a "solid state" target that visually reveals or indicates the position of "hits" by the projector light beam. For example, a target may be provided that both releases the target objects and also provides persisting or continuous spots of light at the "hit" positions. The least expensive embodiments, will, of course, be those that do not require external powering sources and/or sandwiched layers of light sensitive and light emission materials; such as may be provided by using merely a photoconductor layer or a layer of light scintillating material.

I claim:

1. A light sensitive display panel useful as a target having an extended light sensitive surface area that selectively responds at each different position thereof to the application of an irradiating light from a light source to emit a generated visible light at each said applied illuminated position, comprising:

a thin layer photoconductor material disposed over said extended area and selectively responsive to the application of irradiating light at each said different position to selectively change its electrical resistance from a higher to a lower electrical resistance, an electrically energizable thin electroluminescent light generating layer in intimate, electrically conductive relationship with said photoconductor material and including a light scintillation material for providing a light display, and means connecting an electrical powering source in series circuit relationship with said thin layer photoconductor material and said thin layer light generating material, and applied to the various different positions of said extended surface area, whereby the application of an irradiating light at any of said different positions lowers the electrical resistance of the photoconductor material and applies the electrical powering source to activate said light generating material to generate light which, in turn, maintains the photoconductor material at the lower resistance to regenerate the generated light after the irradiating light is withdrawn.

2. In the target panel of claim 1, said photoconductor layer having a discontinuous spatial pattern along the surface of the target to prevent progressive spreading of the regenerative light.

3. In the target panel of claim 1, said light sensitive layer further including an adjoining thin scintillation layer to amplify the response of the photoconductor layer to the light beam.

* * * * *